United States Patent [19]

Gueret

[11] Patent Number: 4,841,996

[45] Date of Patent: Jun. 27, 1989

[54] APPLICATOR DEVICE FOR A LIQUID PRODUCT, NAIL VARNISH IN PARTICULAR

[75] Inventor: Jean-Louis H. Gueret, Paris, France

[73] Assignee: "L'Oreal" , Paris, France

[21] Appl. No.: 147,641

[22] Filed: Jan. 25, 1988

Related U.S. Application Data

[63] Continuation of Ser. No. 893,921, Aug. 6, 1986, abandoned.

[30] Foreign Application Priority Data

Aug. 9, 1985 [FR] France ..... 85 12206
May 29, 1986 [FR] France ..... 86 07700

[51] Int. Cl.[4] ..... A45D 40/26
[52] U.S. Cl. ..... 132/320; 401/129
[58] Field of Search ..... 132/88.7, 74.5, 75, 132/79 C, 79 B, 79 R; 401/129, 119, 118, 138, 100, 101

[56] References Cited

U.S. PATENT DOCUMENTS

| | | | |
|---|---|---|---|
| 1,915,599 | 6/1933 | Ellison | 401/119 |
| 2,250,046 | 7/1941 | Higgins | 401/119 |
| 2,561,252 | 7/1951 | Waring | 401/129 |
| 2,791,789 | 5/1957 | Smith et al. | 401/119 |
| 2,869,162 | 1/1959 | Dritz | 401/119 |
| 3,246,657 | 4/1966 | Roller | 401/129 |
| 4,313,686 | 2/1982 | Proffer | 401/129 |

FOREIGN PATENT DOCUMENTS

| | | | |
|---|---|---|---|
| 1064021 | 8/1959 | Fed. Rep. of Germany . | |
| 1557312 | 9/1969 | Fed. Rep. of Germany . | |
| 2639514 | 3/1978 | Fed. Rep. of Germany . | |
| 3240152 | 5/1984 | Fed. Rep. of Germany | 401/129 |
| 940464 | 5/1948 | France | 401/129 |
| 953504 | 12/1949 | France | 401/129 |
| 993893 | 11/1951 | France | 401/129 |
| 66343 | 6/1956 | France | 401/129 |
| 95093 | 6/1970 | France . | |
| 2486375 | 1/1982 | France . | |
| 7071 | 3/1908 | United Kingdom . | |
| 2064314 | 6/1981 | United Kingdom | 401/129 |

*Primary Examiner*—Gene Mancene
*Assistant Examiner*—J. Hakomaki
*Attorney, Agent, or Firm*—Cushman, Darby & Cushman

[57] ABSTRACT

An applicator for a viscous liquid such as nail varnish has an applicator brush in the form of a tuft of hairs which is anchored at its upper end in an applicator stem and a part of the tuft downwardly of the point of anchorage is surrounded by a reservoir space R into which an optional air hole passes. While the applicator brush is being used, varnish or other liquid passes axially along the tuft from the reservoir R, thereby increasing the duration of an applicator phase before the need to reimmerse the tuft in the liquid product L in the bottle.

15 Claims, 3 Drawing Sheets

APPLICATOR DEVICE FOR A LIQUID PRODUCT, NAIL VARNISH IN PARTICULAR

This is a continuation of application Ser. No. 893,921, filed Aug. 6, 1986, which was abandoned upon the filing hereof.

FIELD OF THE INVENTION

The invention relates to an applicator device for a liquid product contained in a bottle, a device of the kind comprising an applicator brush carried by a cap, or similar, intended to close the neck of the bottle and to be fixed on this neck with the brush situated inside the bottle.

The invention concerns more particularly but not exclusively, applicator devices for nail varnish.

PRIOR ART

It is known that the use of such applicator devices comprising a brush necessitates frequent immersion of the brush in the liquid for replenishing it with the product.

To remedy this drawback, it has already been proposed to use "marker" type applicators which, however, do not allow liquids to be used having formulas approximately to the traditional formulas, in particular in the field of nail varnish. These applicators, moreover, pose problems of sealing and generally comprise relatively complicated valve mechanisms.

OBJECTS OF THE INVENTION

The principal object of the invention is to provide an applicator device for a liquid product, of the kind defined above, such that it meets the various practical requirements better than heretofore.

It is a further object of the invention to make it possible to reduce substantially the number of times necessary for immersing the brush in the bottle to spread the product.

It is yet another object of the invention to provide such an applicator device comprising a brush which is always in contact with liquid, once the cap is replaced on the bottle, which prevents the brush from drying out.

SUMMARY OF THE INVENTION

These objects, as well as others which will emerge below, are attained by an applicator device for a liquid product contained in a bottle comprising an applicator brush which is formed by a stem carrying at one end a tuft of hairs and being joined at its opposite end to a cap or the like, intended to close the bottle neck and to be fixed on this neck with the brush situated inside the bottle, the said applicator device comprising reservoir means capable of storing some liquid product of the bottle in order to feed the hairs of the applicator brush when the brush is withdrawn from the bottle with a view to applying some of the product, these reservoir means being capable of replenishment between two uses of the brush. The said reservoir means are constituted by an interstice formed between the applicator brush and a tubular sleeve surrounding it and whose base is in contact with the hairs of the brush when the brush is withdrawn from the bottle.

In accordance with a first embodiment of the present invention, the reservoir means are provided in the brush stem which stem comprises a hollow portion constituting the interstice delimited by the wall forming the downwardly open sleeve of the stem, the hairs of the brush being accommodated in the interstice.

Advantageously, the hairs of the brush are embedded in the bottom of the hollow portion of the stem and extend over the whole length of this hollow portion, while spreading out to project outside the said hollow portion.

Generally, an air hole is provided in the wall surrounding the hollow portion towards the centre of this portion to facilitate replenishment of the stem interior.

The applicator device preferably comprises a wiper mounted inside the bottle neck and fitted in its lower portion with a lip capable of wiping the stem when it is withdrawn from the bottle, the air hole being provided in the wall of the stem so as to be located below the wiper when the brush is fitted on the bottle.

In accordance with a second embodiment of the present invention, the sleeve fixed in relation to the brush comprises at least one notch in the free edge of the sleeve opposite the portion of the set of hairs of the brush which is next to the stem. In particular, the or each notch is V-shaped.

In accordance with a particular embodiment of the present invention, the sleeve forms an element attached to the applicator brush and comprises fixing means complementary to the means carried by the applicator brush.

The fixing means carried by the sleeve consist, for instance, of an internal catch-engagement bead engaging complementary fixing means carried by the applicator brush and consisting of an external groove intended to accommodate the said catch engagement bead.

Preferably, the sleeve is cylindrical with a circular cross-section whose axis is identical with that of the applicator brush, the brush stem comprising: a portion with an oval cross-section in the region adjacent to the tuft of hairs of the brush; and, on the opposite side from the tuft near the transition zone with the cap, a portion whose cross-section is a cylindrical shell of a circular cross-section and which comprises, over at least one circular cross-section cylindrical sector, the means fixing the said applicator brush to the sleeve by catch-engagement. In particular, the portion of the stem whose cross-section is cylindrical is delimited by two opposite cylindrical sectors and by two opposite half-flats parallel to the axis of the applicator brush, these half-flats being situated in the extension of the greatest curvature walls of the oval cross-section portion of the stem.

The tuft of hairs of the brush of the device in accordance with the present invention may, in particular, have a flattened shape; in that case, it is advantageous to provide a notch disposed opposite the median longitudinal plane of the tuft of hairs.

In accordance with another characteristic of the device, the applicator brush enters the bottle via an opening edged by the pliable lip of a wiper cooperating with the external wall of the sleeve.

In accordance with a third embodiment, the reservoir means may comprise a sleeve slidably mounted in the cap, provision being made for elastic means for straining the sleeve in such a way that, when the cap is fitted on the bottle, the sleeve is pushed back towards the end panel of the cap so as to release that portion of the stem next to the hairs of the brush and, when the cap is removed, the sleeve is displaced by the elastic means and surrounds the above-mentioned portion of the brush stem as far as the base of the brush hairs, some of the liquid product being trapped between the brush stem and the sleeve.

Preferably, the elastic means comprise a helical spring mounted between the cap and a tubular member inside the cap and on which the brush stem is fixed, this tubular member serving for guiding the displacement of the sleeve.

The bottle is fitted with a duct mounted inside its neck. The base of this duct constitutes a stop for the sleeve when the cap is mounted on the bottle to push the sleeve back into a high position.

The stem supporting the brush may have an undulating shape in its portion situated near the hairs of the brush.

In the first and third embodiments of the present invention it may be advantageous for the internal portion of the brush stem or of the sleeve to comprise capillary striations.

BRIEF DESCRIPTION OF THE DRAWINGS

Apart from the features set out above, the invention involves several other objects and advantages which will be discussed in greater detail below in connection with particular but non-restrictive embodiments, described with reference to the accompanying drawings.

In these drawings.

DESCRIPTION OF THE PREFERRED EMBODIMENTS

Figure 1:
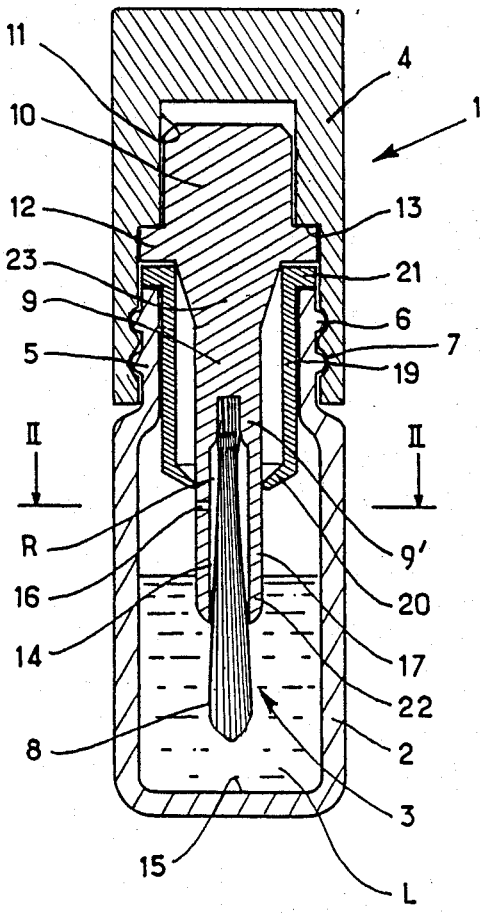
FIG. 1 is a transverse cross-section of a bottle provided with an applicator device in accordance with a first embodiment of the invention.

Referring to FIG. 1 of the drawing, there can be seen an applicator device 1 for a liquid product L contained in a bottle 2. In the example considered, the liquid product is nail varnish.

The device 1 comprises an applicator brush 3 which is carried by a cap 4 or the like intended to close the neck 5 of the bottle and to be fixed on this neck with the brush 3 situated inside the bottle. Generally the neck 5 comprises an external thread 6 capable of cooperating with a conjugate internal thread 7 of the cap 4 to fix the cap in place. The bottle 2 is generally made of glass, whilst the cap 4 is made of a plastic material, in particular polypropylene.

The brush 3 comprises a tuft of hairs 8 carried by a stem 9 whose upper portion forms a head 10 with a larger diameter, held in a recess 11 of the cap 4. At its base, the head 10 comprises a peripheral flange 12 axially abutting a shoulder 13 marking the separation between the larger diameter internal portion of the cap 4 and the inlet of the recess 11. The head 10 is fixed in the recess 11 by any appropriate means, in particular by force-fitting or bonding.

The applicator device 1 comprises reservoir means R capable of storing some of the liquid product L of the bottle so as to feed the brush 3 when the brush has been withdrawn from the bottle 2 with a view to applying this liquid product.

Figure 2:
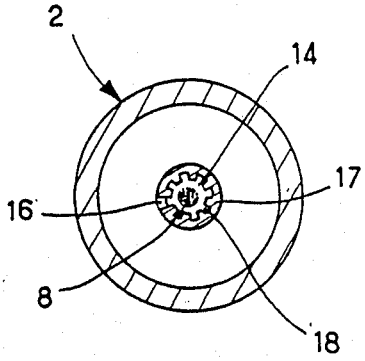
FIG. 2 is a cross-section along line II—II of FIG. 1.

In accordance with the embodiment of FIGS. 1 and 2, reservoir means R are provided in the stem 9 whose diameter is relatively large. This stem 9 comprises a hollow portion 14 opening towards the bottom 15 of the bottle and accommodating the hairs 8 of the brush. The reservoir means R, that is to say, the chamber corresponding to the hollow portion 14, are capable of replenishment by capillarity when the hairs 8 of the brush are immersed in the liquid product L.

This hollow portion 14 constitutes a chamber or an interstice, of cylindrical shape, delimited by the wall 17 forming the sleeve of the stem 9. It is coaxial with the stem 9 and is open at its lower portion. The hairs 8 of the brush are embedded in the bottom 9' of the hollow portion and extend over the whole length of this hollow portion 14, while spreading out to project outside the said hollow portion 14. The hairs 8 form a brush of the type used for water colours which has the advantage, in contrast to the conventional nail varnish brushes generally used, of ensuring an effective control of the flow and discharge of the varnish. There is an air hole 16, in the wall 17 surrounding the hollow portion, and situated substantially towards the centre of this hollow portion to facilitate replenishment of the interior of the stem 9 with the liquid product L. As may be seen in FIG. 2, the hollow portion of the stem 9 comprises capillary striations 18 orientated parallel to the axis of the stem and promoting the rising and retention of the liquid product in the hollow portion 14.

A wiper 19 of a pliable material, in this case an elastomeric material, is mounted inside the neck 5 and is provided in its lower portion with a lip 20 surrounding the stem 9 on which it exerts a light pressure.

The wiper 19 comprises, in its upper portion, a radially outwardly projecting flange 21 capable of bearing against the end of the neck and of being gripped between the end of the neck 5 and the flange 12 referred to above.

The position of the air hole 16, and the axial dimension of the wiper 19, are chosen so that the air hole 16 is located as shown in FIG. 1 below the lip 20 of the wiper when the brush 3 is in the bottle. The pressure inside the hollow portion 14 is thus in balance with the pressure in the bottle 2.

The lower end 22 of the stem 9 forming the base of the chamber 14 is in contact with the hairs of the brush. The upper end 23 of the stem 9 forms a frusto-conical transition zone to the head 10.

The operation and use of the applicator device 1 are as follows.

When the cap 4 is screwed on the neck 5 of the bottle 2, the brush 3 is located inside the bottle. When the hairs 8 of the brush penetrate into the liquid product L, in this case the varnish, the product rises by capillarity along the hairs as far as the hollow portion or chamber 14 of the stem 9, thus forming a reservoir. This rising of the liquid product is facilitated by the presence of the air hole and the capillary striations 18.

When the stopper 4 is unscrewed and the brush 3 is withdrawn from the bottle 2, the stem 9 is wiped by the lip 20 of the wiper. The reservoir of the liquid product remains in the hollow portion 14.

The application of the liquid product, namely nail varnish, then takes place. In the course of the application by the hairs 8, the liquid product contained in the hollow portion 14 feeds the hairs, thanks to the striations 18, until this hollow portion 14 has become empty.

With such a suitably dimensioned applicator device 1, especially as regards the hollow portion 14, it is possible to apply the nail varnish over the whole hand without having to reimmerse the hairs 8 of the brush 3 in the liquid product of the bottle.

Figure 3:
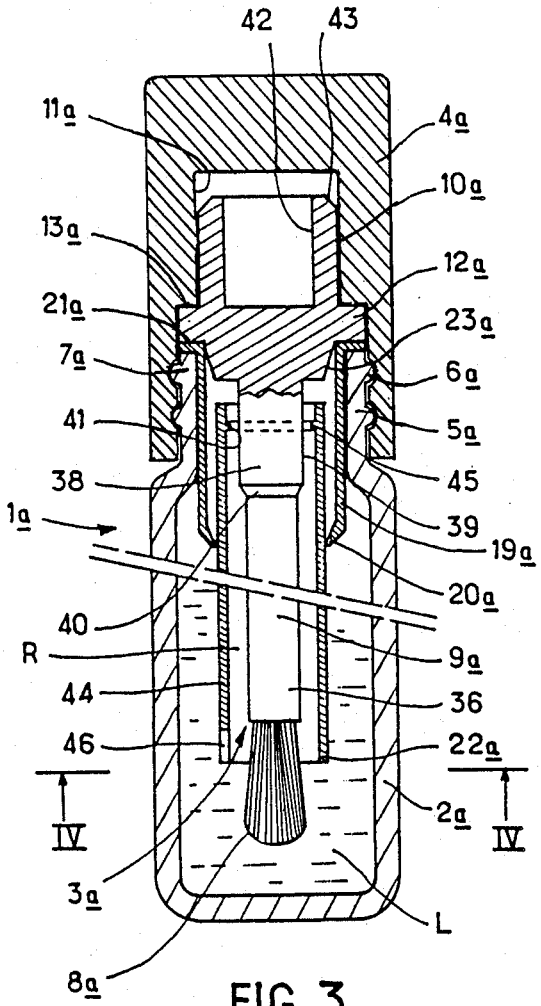
FIG. 3 is an axial cross-sectional view of a bottle provided with an applicator device according to a second embodiment of the present invention, the stem of the applicator brush being partly shown in elevation.
Figure 5:
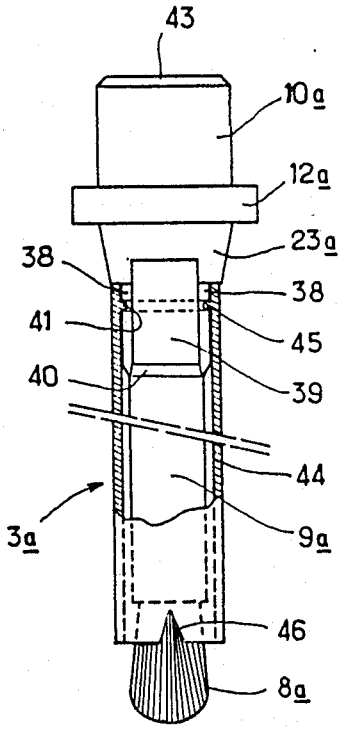
FIG. 5 is a partly cross-sectional and partly elevational view of the applicator device of FIG. 3, viewed at an angle displaced by 90° in relation to the representation of FIG. 3.
Figure 4:
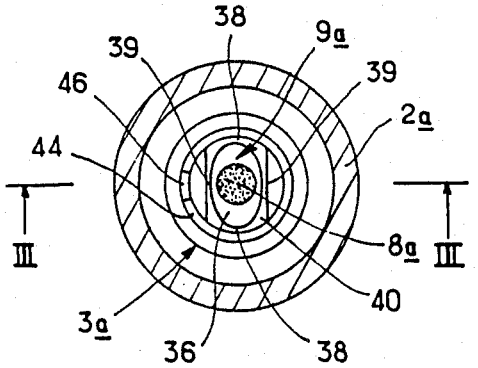
FIG. 4 is a cross-sectional view along line IV—IV of FIG. 3, FIG. 3 itself being an axial cross-section along line III—III of FIG. 4.

FIGS. 3 to 5 relate to a second embodiment of the present invention wherein those elements which are similar or equivalent to the elements already described with reference to FIGS. 1 and 2 are designated by the same numerals followed by the letter *a*. Their description will not be repeated, or if so then only briefly.

A wiper 19*a* of pliable material, in particular of an elastomeric material, is mounted inside the neck 5*a* and is provided, in its lower portion, with a lip 20*a* surrounding the sleeve attached to the applicator brush 3*a* (which sleeve will be described below) whereon it exerts light pressure.

The wiper 19*a* comprises, at its upper portion, a radially outwardly projecting flange 21*a* capable of bearing on the end of the neck 5*a* and of being gripped between the end of the neck 5*a* and the flange 12*a* of the head 10*a* of the applicator brush 3*a* described below.

The brush 3*a* comprises hairs 8*a* carried by a stem 9*a* whose upper portion forms a head 10*a* secured in a recess 11*a* of the cap 4*a*. The head 10*a* and the stem 9*a* proper are joined by transition zone 23*a* of a generally frusto-conical shape.

The stem 9*a* comprises, successively between the hairs 8*a* and the head 10*a*: a portion 36 of an oval cross-section as may be seen in FIG. 4; and a portion which is of smaller height than the portion 36 and which is delimited on the one hand by two opposite sides 38 forming two sectors of one and the same cylinder whose axis is identical with the axis of the stem 9*a* and two opposite half-flats 39 parallel to the axis of the stem 9*a*. The two portions of the stem 9*a* are joined by a shoulder 40 flaring from the portion 36 towards the other portion.

Moreover, in each of the walls 38, there is an annular groove 41 situated in a plane perpendicular to the axis of the stem 9*a* near the transition zone 23*a* of the stem to the head 10*a*, each groove extending from one edge to the other of the respective part cylindrical wall 38.

The head 10*a*, having an overall cylindrical shape, is secured in a recess 11*a* of the cap 4*a*. It comprises at its base, that is to say near the zone 23*a*, the above-mentioned peripheral flange 12*a*, which axially abuts a shoulder 13*a*, marking the separation between the larger diameter internal portion of the cap 4*a* and the inlet of the recess 11*a*. Moreover, in the end wall of the head 10*a* is a cylindrical cut out 42 whose axis is identical with that of the applicator brush 3*a*. To facilitate the insertion of the said applicator brush 3*a* in the recess 11*a*, the free external edge of the head 10*a* is chamfered. The head 10*a* is fixed in the recess 11*a* by an appropriate means, in particular by force-fitting or bonding.

The applicator device 1*a* comprises reservoir means R capable of storing some of the liquid product L of the bottle 2*a* so as to supply the applicator brush 3*a* when the brush is withdrawn from the bottle 2*a* for application of the product.

These reservoir means R are formed by the interstice existing between the stem 9*a* and the adjacent portion of the set of hairs 8*a*, and a cylindrical external sleeve 44 fixed to the stem 9*a*. For this purpose the sleeve 44 has, near its edge on the opposite side to that facing the tuft of hairs 8*a*, an internal peripheral ring 45 intended to cooperate with the grooves 41 in the cylindrical sectors 38, these latter being situated in the extensions of the smaller curvature walls of the portion 36 of the oval section of the stem 9*a*.

Moreover, along its lower edge 22*a* opposite the hairs 8*a* in the mounted position of the said sleeve 44, the sleeve 44 comprises a V-shaped notch 46. As may be seen in FIGS. 3 and 5, the tuft of hairs 8*a* has a flattened shape. It is arranged that in the final position, the notch 46 is situated opposite the median longitudinal plane of the said tuft of hairs 8*a*.

The mounting of the sleeve 44 on the applicator brush 3*a* is extremely simple since it suffices to slide the sleeve 44 around the end of the stem 9*a* carrying the hairs 8*a* until the retaining ring 45 becomes catch engaged in the grooves 41, and then to adjust the sleeve 44 by rotation so that the notch 46 has precisely the desired position in relation to the set of hairs 8*a*.

When the cap 4*a* is screwed on to the neck 5*a* of the bottle 2*a*, the applicator brush 3*a* is inside the bottle 2*a*. When the hairs 8*a* penetrate into the liquid, e.g. nail varnish, the liquid rises by capillarity along the hairs 8*a* up to the interstice forming the reservoir R.

When the stopper 4*a* is unscrewed, and the brush 3*a* is withdrawn from bottle 2*a*, the sleeve 44 is wiped by the lip 20*a* of the wiper 19*a*. The reservoir R of the liquid product remains in the above mentioned interstice.

The application of the liquid product can then be effected. In the course of this application, the liquid contained in the reservoir R feeds the hairs 8*a*, and this is facilitated by the presence of the notch 46, until this reservoir R has become exhausted.

With such a suitably dimensioned applicator device 1*a*, particularly as regards the reservoir R, it is possible to apply the nail varnish over the whole of one hand without having to re-immerse the hairs 8*a* of the applicator brush 3*a* in the liquid of the bottle 2*a*.

Figure 6:
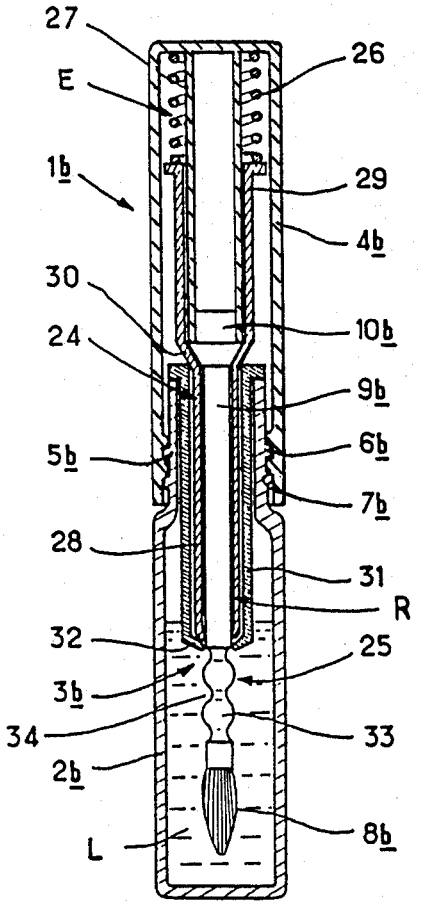
FIG. 6 is an axial cross-section of a bottle provided with an applicator device in accordance with a third embodiment of the invention.
Figure 7:
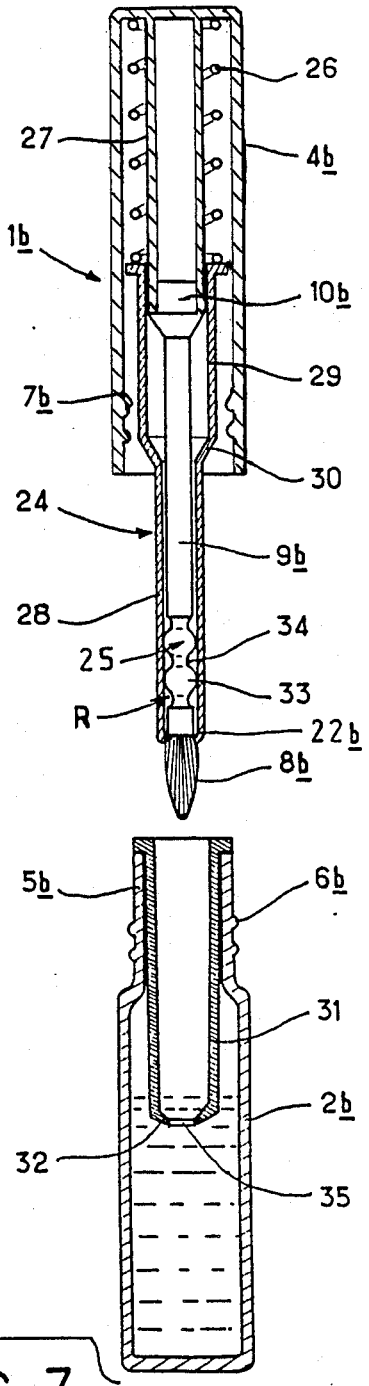
FIG. 7 shows the bottle of FIG. 6 when the cap has been withdrawn therefrom.

FIGS. 6 and 7 show another embodiment wherein those elements which are similar or equivalent to the elements already described with reference to FIGS. 1 and 2 are designated by the same numerals followed by the letter *b*. Their description will not be repeated or if so then only briefly.

The reservoir means R comprise a sleeve 24 slidably mounted to the cap 4*b*. Elastic means E restrain the sleeve 24 so that when the cap 4*b* is fitted on the bottle 2*b*, the sleeve 24 is biased towards the bottom of the cap so as to release the portion 25 of the stem next to the hairs 8*b* of the brush whilst, during the removal of the cap 4*b*, the sleeve 24 comes to surround the above-mentioned portion 25 of the stem, under the action of the elastic means, as far as the base of the hairs 8*b* of the brush.

The elastic means E are advantageously provided between the bottom of the cap 4*b* and the sleeve 24. Preferably, these elastic means E are formed by a helical spring 26 mounted inside the cap around a tubular member 27 integral with the cap and coaxial with it.

The stem 9b of the brush is fixed at its head 10b in the lower open end of the tubular member 27.

The sleeve 24 comprises a lower portion 28 of smaller diameter, within which the stem 9b slides with restricted play, and an upper portion 29 of larger diameter in which the tubular member 27 is fitted with restricted play. This tubular member 27 thus serves to guide the sliding displacement of the sleeve 24. The transition between these two portions 28 and 29 is at a frusto-conical zone 30.

The portion 28 of sleeve 24 comprises, internally, longitudinal capillary striations similar to the striations 18 of FIG. 2.

The bottle 2b is provided with a duct 31 mounted inside its neck 5b. The base 32 of this duct forms a stop for the lower end of the sleeve 24 when the cap 4b is fitted on the bottle 2b. This stop 32 biases the sleeve 24 into a high position against the spring 26 as shown in FIG. 6.

The stem 9b, provided with hairs 8b, preferably has an undulating shape in its portion 25 situated near the hairs of the brush. This undulating shape may be obtained by a succession of spherical or substantially spherical bulges joined by smaller diameter zones 34. This undulating shape favours the retention of some of the liquid product on the portion 25. The hairs 8b are fixed at the base of this portion 25 which they extend.

The passage opening 35 of the duct 31 has a larger diameter than the maximum diameter of both the stem 9b and the stem lower portion 25.

The functioning and use of the applicator device 1b of FIGS. 6 and 7 are as follows.

When the stopper 4b is screwed onto the bottle 2b, the lower end of the sleeve 24 abuts the base 32 of the duct 31 and this pushes the sleeve 24 against the spring 26, as shown in FIG. 6.

The portion 25 of the stem 9b penetrates into the bottle 2b with the hairs 8b and they become impregnated with the liquid product L.

When the cap 4b is unscrewed, the stem 9b takes out, essentially by means of its portion 25, a certain quantity of liquid adhering to its surface.

Because of the larger diameter of the opening 35 the portion 25 of the stem is not wiped, and the liquid product is placed in reserve within the sleeve 24, and more particularly the portion 28 is not wiped, when the portion 25 of the stem enters the sleeve, as shown in FIG. 7.

In the position of use, shown in FIG. 7, the sleeve 24 comes into contact at its lower end 22b with the base of the hairs 8b of the brush, so as to ensure that the brush is properly fed by the reserve stored in the sleeve 24, and in particular by the striations (similar to the striations 18) which serve as reservoir.

The application of the product, e.g. to the fingernails, is then effected in the conditions explained above with reference to FIGS. 1 and 2.

It is also possible to apply the nail varnish over the whole of one hand without having to recharge the brush with the product by re-immersion in the bottle 2b.

The tuft of hairs 8b of FIGS. 6 and 7 preferably has a "tear drop" shape allowing the flow to be controlled.

Whatever the embodiment, once the cap has been screwed back onto the bottle, the brush is always in contact with the liquid product L and does not dry out.

The explanations given above make it clear that the reserve means R are capable of replenishment between two uses of the brush, each use following a removal of the cap from the bottle.

As can be understood, in the three embodiments described above the reservoir means R are situated outside the hair tuft of the applicator brush (3,3a,3b): because of this, the liquid product L does not pass between the hairs (8,8a,8b) fixed in the stem (9,9a,9b) but instead passes axially along the outer surface of the tuft.

I claim:

1. An applicator device, for a liquid product, comprising:

(a) a bottle;

(b) a cap for closing the neck of said bottle;

(c) applicator brush means constituted by a stem carrying at one end a tuft of hairs and being joined at its opposite end to said cap, said stem comprising a closed, solid body, said applicator brush means being disposed inside the bottle when the cap is fixed on said bottle neck;

(d) reservoir means for storing some of the liquid product for feeding the hairs of the applicator brush means when the applicator brush means is withdrawn from the bottle for application of the liquid product, said reservoir means including sleeve means disposed about said stem and spaced radially outwardly from said stem to define interstice means between said stem and said sleeve means, said reservoir means being capable of replenishment between two uses of the brush means; and (e) a tubular sleeve surrounding a portion of the applicator brush means and having an end including wiper means which, at least when the applicator brush means is withdrawn from the bottle, is in wiping contact with the hairs of said brush means; said tubular sleeve being fixed relative to the neck of said bottle, said tubular sleeve being cylindrical and having a central axis, said brush means having an axis coextensive with said axis of said tubular sleeve, at least a portion of said solid body of said stem being oval in cross-section at least adjacent said end of said stem which carries said tuft of hair.

2. A device according to claim 1, wherein said sleeve means is fixed in relation to the brush means and comprises notch means in its free edge adjacent that portion of the tuft of hairs of the brush which is near said stem.

3. A device according to claim 2, wherein said notch means comprise at least one V-shaped notch.

4. A device according to claim 2, wherein the sleeve means constitutes an element attached to said applicator brush means and comprises complementary first and second fixing means carried by the said applicator brush means and said sleeve means, respectively.

5. A device according to claim 4, wherein said second fixing means, carried by the sleeve means, comprises of an internal catch-engagement bead, and wherein said first fixing means, carried by the applicator brush means, comprises external groove means intended to accommodate said catch-engagement bead.

6. A device according to claim 2, wherein the stem further comprising at the opposite side from the said tuft near its zone of transition with the cap a circular cylindrical portion which comprises over at least one circular cross-section cylindrical section thereof said first fixing means for fixing the said applicator brush means to said cylindrical sleeve by catch-engagement.

7. A device according to claim 6, wherein said circular cross-section cylindrical portion of the stem is delimited by two opposite cylindrical sectors and by two opposite half-flats parallel to the axis of the applicator brush means, said half-flats being situated in the extension of the greater curvature walls of the oval cross-section portion of said stem.

8. A device according to claim 5, wherein the tuft of the hairs of the applicator brush means has a flattened shape, and wherein the sleeve means comprises means defining at least one notch disposed opposite the median longitudinal plane of the said tuft of hairs.

9. The invention as claimed in claim 1 wherein said sleeve means disposed about said stem includes an upper portion having a passage communicating with the space between said stem and said sleeve means and a space between said sleeve means and said tubular sleeve.

10. An applicator device, for a liquid product, comprising:

(a) a bottle;

(b) a cap for closing the neck of said bottle;

(c) applicator brush means constituted by a stem carrying at one end a tuft of hairs and being joined at its opposite end to said cap, said stem comprising a solid body, said applicator brush means being disposed inside the bottle when the cap is fixed on said bottle neck;

(d) reservoir means for storing some of the liquid product for feeding the hairs of the applicator brush means when the applicator brush means is withdrawn from the bottle for application of the liquid product, said reservoir means including sleeve means carried on said stem so as to be movable between a first position wherein, when said cap is fixed on said neck, said sleeve means is withdrawn to expose a portion of said stem and said tuft on said one end of said stem and a second position wherein, when said cap is removed from said neck, said sleeve means covers said portion of said stem, said portion of said stem adjacent said tuft having interstice means for receiving the liquid, said reservoir means being capable of replenishment at least between two uses of the brush means, and (e) a tubular sleeve surrounding a portion of the applicator brush means and having an end including wiper means which, at least when the applicator brush means is withdrawn from the bottle, is in wiping contact with at least said sleeve means of said reservoir means, said tubular sleeve being fixed relative to the neck of said bottle;

said sleeve means being slidably mounted in said cap, said cap further including elastic means to bias said sleeve means such that (a) when the cap is fitted on the bottle, said sleeve means is pushed towards the bottom of the cap so as to release a portion of said stem next to the tuft of hairs, and (b) during the removal of said cap, said sleeve means is displaced by said elastic means to surround at least a portion of said stem at least in the vicinity of said tufts of hair, whereby some of the liquid product will be trapped in the interstice means situated between said stem and said sleeve means.

11. A device according to claim 10, wherein the cap includes an inner tubular member, and wherein the elastic means comprise a helical spring mounted between the cap and said inner tubular member in the cap, wherein the stem of the applicator brush means is fixed on said inner tubular member, and wherein said inner tubular member serves for guiding the displacement of the sleeve means.

12. A device according to claim 10, wherein the bottle is provided with duct means inside its neck, said duct means having a base which forms a stop for the sleeve means when the cap is fitted on the bottle and pushes said sleeve means into said withdrawn position.

13. A device according to claim 1, wherein said sleeve means has a lower portion comprising capillary striations.

14. The device as claimed in claim 2, wherein said bottle includes an opening which is edged by said wiper means including a pliable wiper lip whereby the applicator brush means enters the bottle and engages said lip and wherein said wiper lip cooperates with the exterior of said sleeve means.

15. The device as claimed in claim 10, wherein said interstice means comprises an undulating portion of said stem adjacent said tuft.

* * * * *